US005503387A

United States Patent [19]

Straessler et al.

[11] Patent Number: 5,503,387

[45] Date of Patent: Apr. 2, 1996

[54] DEVICE FOR CONVEYING INDIVIDUAL PRINTED PRODUCTS OF A SCALE-SHAPED FLOW

[75] Inventors: René Straessler, Jestetten, Germany; Beat Fritsche, Greifensee, Switzerland

[73] Assignee: Grapha-Holding AG, Hergiswil, Switzerland

[21] Appl. No.: 284,401

[22] PCT Filed: Nov. 16, 1993

[86] PCT No.: PCT/CH93/00258

§ 371 Date: Aug. 3, 1994

§ 102(e) Date: Aug. 3, 1994

[87] PCT Pub. No.: WO94/13565

PCT Pub. Date: Jun. 23, 1994

[30] Foreign Application Priority Data

Dec. 4, 1992 [CH] Switzerland ..... 03 731/92

[51] Int. Cl.[6] ..... B65H 29/00

[52] U.S. Cl. ..... 271/280; 414/792.7; 271/282

[58] Field of Search ..... 198/418.7, 468.9; 271/280, 282; 414/788.1, 792.7, 798.9

[56] References Cited

U.S. PATENT DOCUMENTS

| | | | |
|---|---|---|---|
| 3,464,537 | 9/1969 | Thull . | |
| 4,004,694 | 1/1977 | Sjogren . | |
| 4,932,647 | 6/1990 | Svensson | 414/798.9 |

FOREIGN PATENT DOCUMENTS

| | | | |
|---|---|---|---|
| 2200831 | 4/1974 | France . | |
| 2820957 | 12/1978 | Germany . | |
| 280157 | 12/1987 | Japan | 271/280 |
| 150642 | 6/1989 | Japan | 271/280 |
| 52853 | 2/1990 | Japan | 271/280 |
| 173654 | 6/1992 | Japan | 271/280 |

*Primary Examiner*—William E. Terrell
*Assistant Examiner*—Gregory A. Morse
*Attorney, Agent, or Firm*—Spencer & Frank

[57] ABSTRACT

A device for conveying individual printed products to a second conveying track from a staggered flow of printed products on a first conveying track. A step is formed between the first conveying track and the second conveying track. The second conveying track branches off from the first conveying track at the step and has a front end disposed adjacent the step. The device includes a carriage disposed on the second conveying track and adapted to assume an oblique movement toward and away from the step. The carriage includes a flap disposed thereon. The flap can be pivoted into and out of an effective area of the first conveying track for engaging and disengaging individual products from the staggered flow. The device further includes a drive for conveying the individual printed products in the second conveying track, and components coupled to the carriage and the drive means for increasing a conveying speed of the individual printed products in the second conveying track by increasing a speed of the drive means. The increase in the conveying speed of the individual printed products is caused by the movement of the carriage away from the step.

9 Claims, 3 Drawing Sheets

DEVICE FOR CONVEYING INDIVIDUAL PRINTED PRODUCTS OF A SCALE-SHAPED FLOW

The invention relates to a device for conveying individual printed products to a second conveying track from a staggered flow of printed products on a first conveying track. A device of this type has become known in the prior art from DE-A-28 20 957. Such a device can be used, for example, to increase the output when processing a scale-shaped or staggered flow coming from a rotary printing press. However, it can also be used for removing faulty printed pieces, or for sorting, etc. It has now been shown that the exact removal of individual printed products is not possible in a dependable manner by means of this device. For this reason this device has not been employed in actual use.

It now is the object of the invention to provide a device of the type mentioned, which dependably allows the correct removal of printed products from a scale-shaped flow, but is still simple to produce.

SUMMARY OF THE INVENTION

The above object is attained with the device in accordance with the invention in that during the movement away from the step the conveying speed of the second conveying track is increased in response to that movement. Because of the increase in speed, a printed product removed from the scale-shaped flow is moved away from the step over a shorter distance and simultaneously more rapidly. In addition, negative shifting is prevented by the increase in conveying speed in the area of the second conveying track. It has also been shown that the increase of the speed of the conveying track per se can be realized very dependably and in a simple structural way by means of a mechanical coupling. Therefore the invention permits the production of a device wherein an elaborate control of the drive mechanism of the second conveying track is avoided.

In accordance with a further embodiment of the invention, the second conveying track has a receiving opening at the front end which can be adjusted in width. By means of the above, the adaptation of the receiving opening to the thickness of the printed products to be removed is possible. If the receiving opening is closed only at the time the advance edge of the printed product to be removed has already been inserted into the receiving opening, there is the considerable advantage that printed products consisting respectively of several sections are not torn apart and can be dependably removed.

Thus it is possible to remove voluminous printed products consisting of several sections considerably faster and over a shorter distance as compared with the prior art. By means of the device in accordance with the invention, the removal is possible over a shorter distance as compared with the prior art.

Further advantageous features ensue from the subsequent description and the drawings.

BRIEF DESCRIPTION OF THE DRAWINGS

An exemplary embodiment of the invention will be described in detail below by means of the drawings. Shown are in.

DETAILED DESCRIPTION OF THE INVENTION

Figure 2:
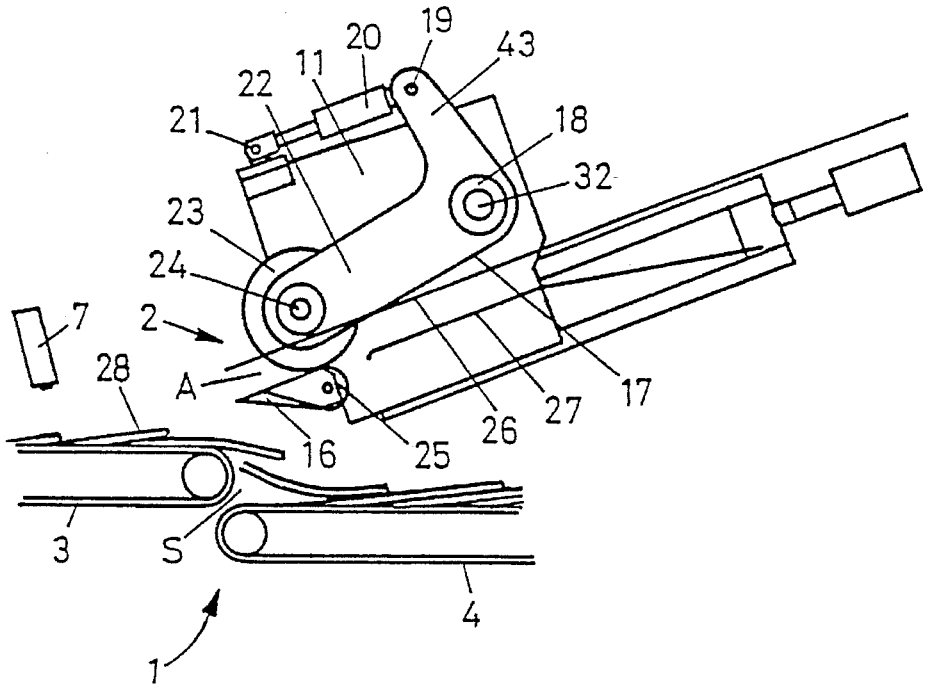

FIG. 2 shows a first conveying track 1 with two conveyor belts 3 and 4, which have a step S for spreading open a scale-shaped flow 28. In FIG. 2 the conveying track transports the scale-shaped flow 28 from left to right over the step S. Above the end of the conveyor belt 3 a counting head 7, known per se, is disposed at a distance from the scale-shaped flow, by means of which the printed products are individually counted and by means of which it is also possible to determine the positions of the printed products. The counting head 7 is fastened to a machine frame 5, for example.

Figure 1:
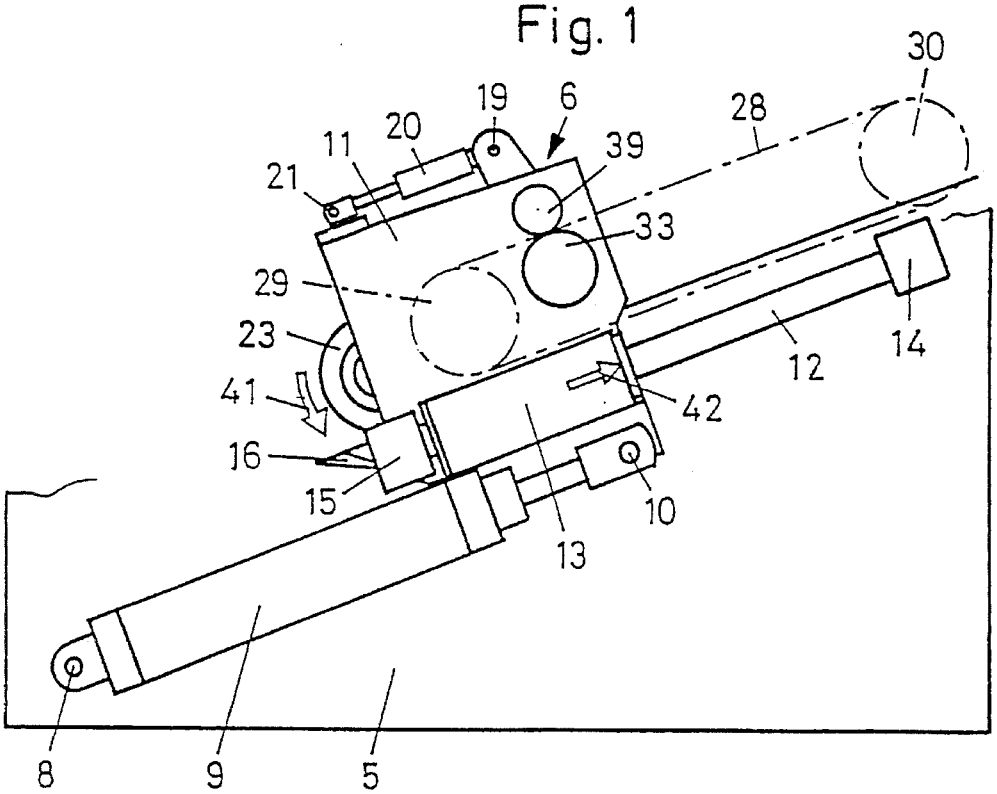
FIGS. 1 and 2, partial views of a device in accordance with the invention, wherein some parts have been respectively left out for reasons of the representation, FIG. 3, a plan view of individual exploded parts of the device in accordance with the invention, and FIGS. 4 to 6, removal of a printed product from a scale-shaped flow schematically.

A second conveying track 2 starts above the step S and extends obliquely upward from it. This second conveying track (2) has a carriage 6 which can be displaced continuously adjustably on a guide rod 12 between stops 14 and 15. For displacing the carriage 6 a double-acting cylinder-piston unit 9 is provided, one end of which is fastened to the machine frame 5 by means of a hinge 8 and the other end of which is attached to a bearing 13 in the carriage 6, also by means of a hinge 10. The lower end position of the carriage 6 is shown in FIG. 1. Thus the carriage 6 can be moved from there upward in the direction of the guide rod 12.

On the carriage 6, a flap 16 is pivotably seated on bearing plates 11 of the carriage. An arm 38 (FIG. 3) has been attached on the side of the flap 16 at a distance from a pivot shaft 37, on which a double-acting cylinder-piston unit, not shown here, is fastened, by means of which the flap can be pivoted up and down, starting from the position in accordance with FIG. 2. A roller 25 is seated on the center of the pivot shaft 37 of the flap 16. This roller 25, which is fixed in respect to the carriage 6, together with a clamping roller 23 seated above it, forms a receiving opening A, through which a printed product 28*a* (FIG. 4) can be introduced between two sliding plates 26 and 27 of the second conveying track 2. The clamping roller 23 is seated on a toggle lever 22 which can be pivoted around a shaft 32 by means of a double-acting cylinder-piston unit 20. The unit 20 is fastened by means of a hinge joint 21 on a bearing plate 11 of the carriage and acts on a joint 19 on an arm 43 of the lever 17. The clamping roller 23 seated on the other arm 22 can be lifted upward off the roller 25, starting at the position shown in FIG. 2, by means of the unit 20. In the opposite direction a pressure can be exerted against the roller 25 by means of the unit 20.

Figure 3:
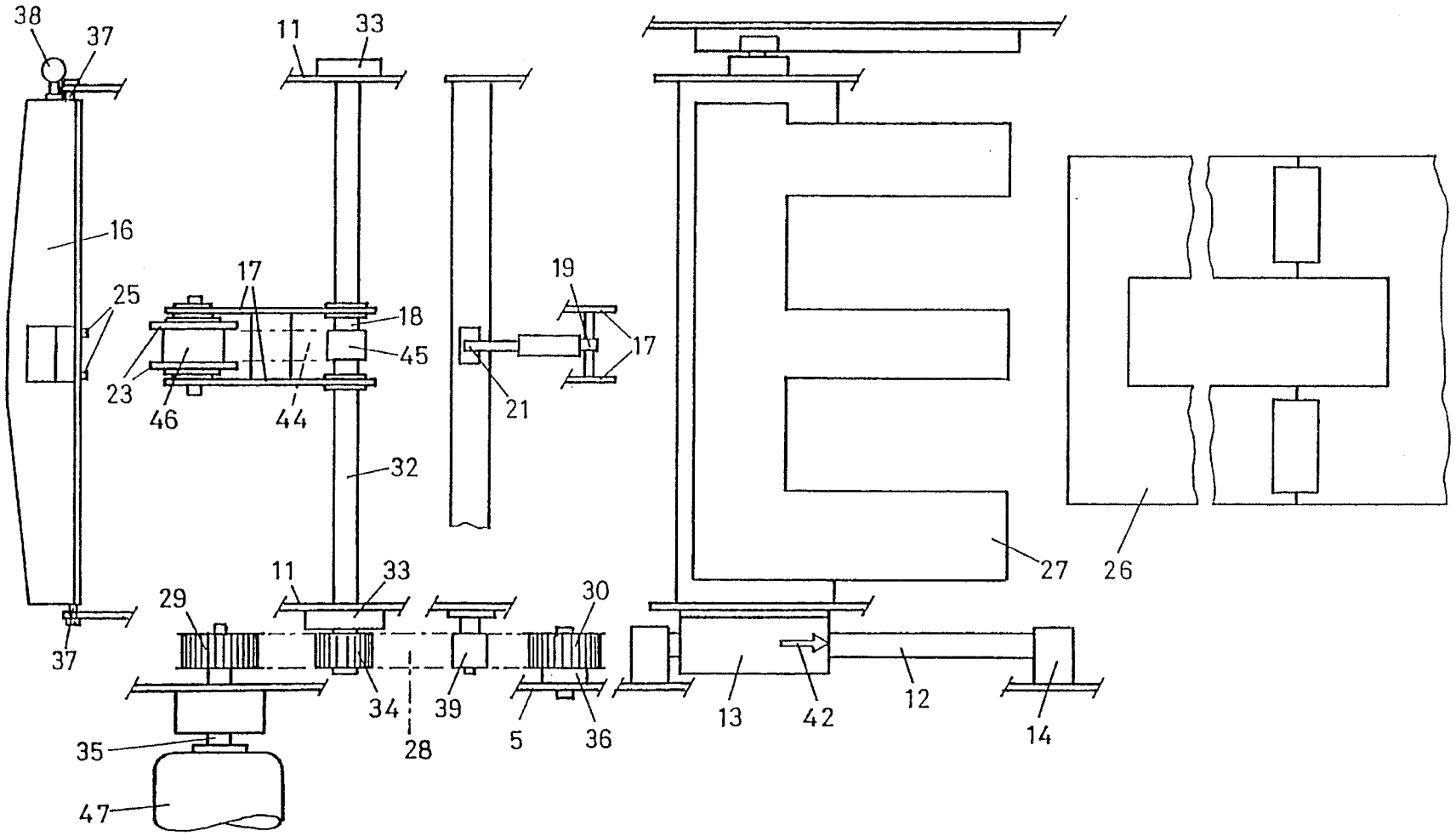

As shown in FIG. 3 in particular, the bearing 18 of the toggle lever 17 is also disposed centered on a shaft 32, the ends of which are rotatably seated on the bearing plates 11 of the carriage 6. As shown in FIG. 3, one end of the shaft 32 extends through a bearing 33 and is connected at this end, fixed against relative rotation, with a gear wheel 34, which on the inside meshes with a toothed belt 28. This belt 28 is guided over rollers 29 and 30, wherein the one roller 29 is fastened on a drive shaft 35. Both rollers 29 and 30 are seated at a distance from each other on the machine frame 5. A further endless drive belt 44 connects a roller 45, fixedly seated on the shaft 32, with a roller 46 which is connected with the clamping roller 23. Pressure roller 29, seated on a bearing plate 11, is provided for the assured connection of the gear wheel 34 with the drive belt 28. A drive motor 47 is connected with the shaft 35, in order to turn in this manner the clamping roller 23 in the direction of the arrow 41 (FIG. 1), independently of the position of the carriage 6. If the carriage 6 is upwardly displaced by means of the cylinder-piston unit in the direction of the arrow 42, the gear wheel 34 is provided with an additional drive because of the engagement with the toothed belt 28 caused by this displacement movement. Thus, with a movement of the carriage 6 in the direction of the arrow 42, the rotational speed of the roller 23 is automatically increased in correspondence to the moving speed of the carriage 6, while the toothed belt 28 retains the same running speed. However, if the carriage 6 is moved opposite the direction of the arrow 42, the rotational speed of the clamping roller 23 slows down correspondingly. The operational characteristics of the device in accordance with the invention will be described below by means of FIGS. 4 to 6.

Figure 4:
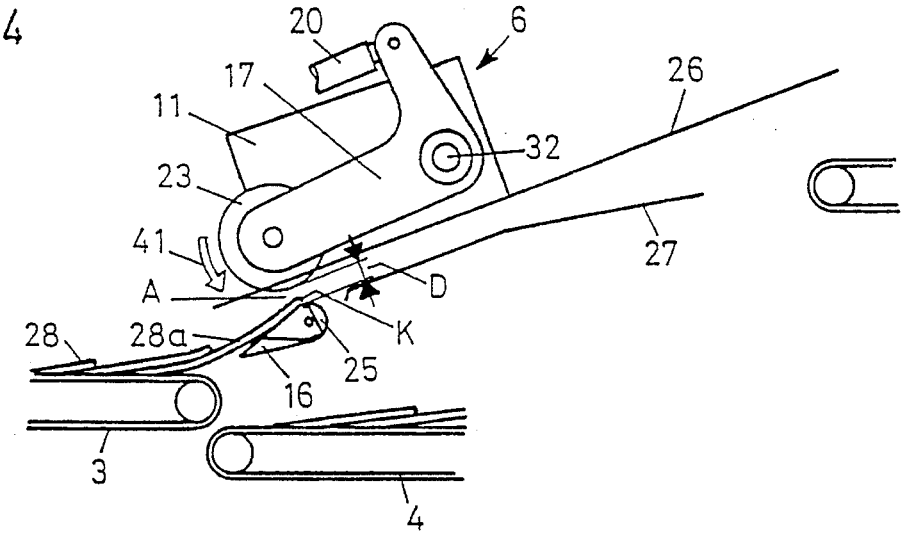

In the arrangement in accordance with FIG. 4, the flap 16 has been pivoted into a lower position, wherein its front end is in engagement with the scale-shaped flow 28. A printed product 28*a* to be removed is received in the flap 16 and its front edge K is located in the receiving opening between the roller 25 and the clamping roller 23. The toggle lever 17 has been set by means of a cylinder-piston unit 20 in such a way that there is a distance D between the rollers 25 and 23. This distance D has been selected such that the printed product 28*a* is pushed between these two rollers without noticeable resistance. In the course of this the clamping roller 23 turns in the direction of the arrow 41 and can grip the printed product 28*a* with a preset pressure.

Figure 5:
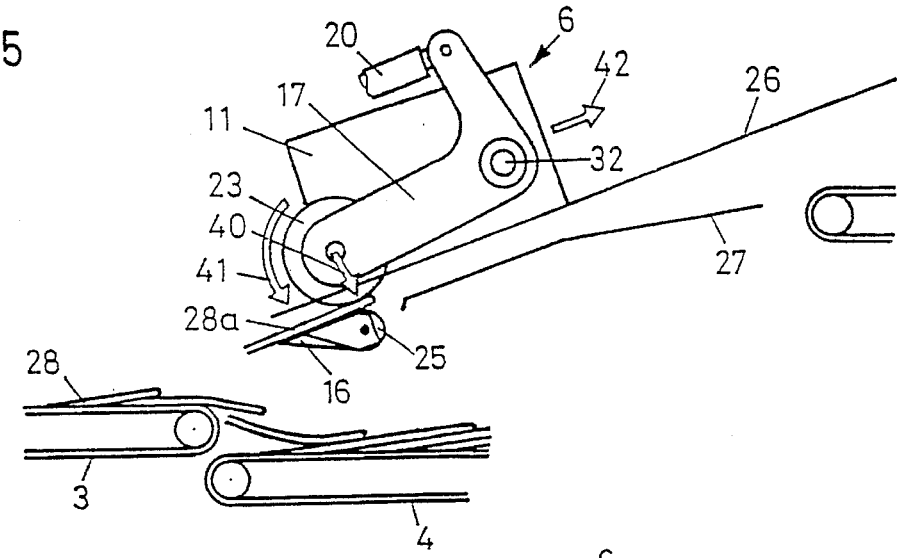
Figure 6:
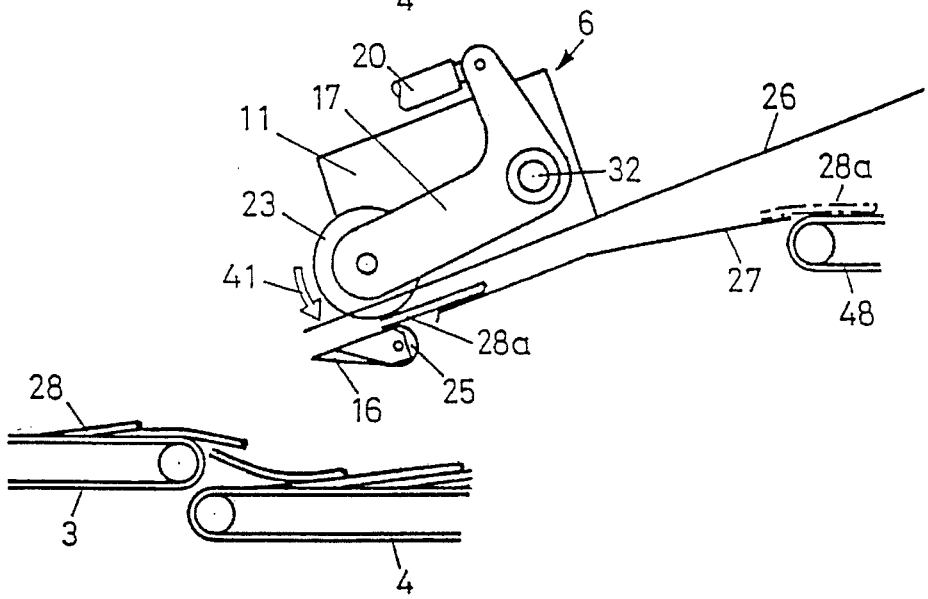

As shown in FIG. 5 toggle lever 17 is now pivoted in the direction of the arrow 40 by means of the unit 20 and the pressure of the rollers 23 and 25 against the printed product 28*a* is increased. At approximately the same time the carriage 6 is displaced upwardly away from the step S toward the right in the direction of the arrow 42. As already explained above, the rotational speed of the roller 23 is increased because of this displacement. The retraction speed of the carriage is approximately 2 m/sec, for example. By means of this the circumferential speed of the clamping roller 23 is increased from 1 m/sec to 3 m/sec, for example. It is not necessary in the course of this to change the speed of the belt 28.

The printed product 28*a* clamped between the rollers 25 and 23 is therefore pulled into the receiving opening A with increased speed during the rearward displacement of the carriage 6. Correspondingly, the loitering time of the printed product 28*a* between the rollers 25 and 23 is shorter in accordance with the speed increase. In addition, the printed product 28*a* is removed in a shorter time from the scale-shaped flow 28.

The removed printed product 28*a* is conveyed by the guide panels 26 and 27 to a further conveyor belt 48, for example, or dropped into a container, not shown here.

Until the removal of a further printed product, the carriage 6 can be maintained in a stand-by position in the position shown in FIG. 4 or immediately moved into the initial position.

We claim:

1. A device for conveying individual printed products from a staggered flow of printed products on a first conveying track to a second conveying track, the first conveying track defining a step and the second conveying track branching off from the first conveying track at the step and having a front end disposed adjacent the step, the device comprising:

a carriage disposed on the second conveying track and adapted to assume an oblique movement toward and away from the step, the carriage including a flap disposed thereon and adapted to be pivoted into and out of an effective area of the first conveying track for engaging and disengaging individual products from the staggered flow;

drive means for conveying the individual printed products in the second conveying track; and means coupled to the carriage and the drive means for increasing a conveying speed of the individual printed products in the second conveying track by increasing a speed of the drive means, the means for increasing being responsive to the movement of the carriage away from the step.

2. The device according to claim 1, wherein the second conveying track includes a receiving opening disposed at its front end for receiving individual printed products from the first conveying track for conveying the printed products to the second conveying track, the receiving opening of the second conveying track having an adjustable width.

3. The device according to claim 1, wherein the drive means includes an upper clamping roller disposed adjacent the front end of the second conveying track, the clamping roller being adapted to be lowered and lifted for clamping and unclamping individual products from the staggered flow.

4. The device according to claim 3, wherein the carriage further includes a pivotal lever, the clamping roller being disposed on the pivotal lever.

5. The device according to claim 1, wherein the means for increasing increases the conveying speed of a printed product in the second conveying track by a predetermined amount.

6. The device according to claim 5, wherein the predetermined amount essentially equals a speed of the carriage in its movement away from the step.

7. The device according to claim 1, wherein the means for increasing includes:

a drive shaft;

a draw-in member disposed at a front region of the carriage and operably connected to the drive shaft; and a drive belt engaging the drive shaft for driving the drive shaft such that, during the movement of the carriage away from the step, the drive shaft engageably rolls on a surface of the drive belt for increasing a rotational speed of the drive shaft by an amount essentially equal to a speed of the carriage in its movement away from the step.

8. The device according to claim 7, wherein the drive belt is one of a toothed belt and a roller chain.

9. A device according to claim 1, wherein a speed of the carriage in its movement away from the step is equal to at least a conveying speed of the staggered flow.

* * * * *